US007196894B2

(12) United States Patent
Maurer et al.

(10) Patent No.: US 7,196,894 B2
(45) Date of Patent: Mar. 27, 2007

(54) METHOD AND A DEVICE FOR DEMAGNETISING OBJECTS

(76) Inventors: Albert Maurer, Wabergstrasse 11, CH-8624 Grüt (CH); Urs Meyer, Hohfurristrasse 1, CH-8172 Niederglatt (CH)

( * ) Notice: Subject to any disclaimer, the term of this patent is extended or adjusted under 35 U.S.C. 154(b) by 414 days.

(21) Appl. No.: 10/603,646

(22) Filed: Jun. 25, 2003

(65) Prior Publication Data

US 2004/0263300 A1 Dec. 30, 2004

(51) Int. Cl.
*H01F 13/00* (2006.01)

(52) U.S. Cl. ..... 361/149; 361/143; 361/267

(58) Field of Classification Search ..... 361/143, 361/267, 147, 148, 270, 151, 204, 156, 180, 361/155, 24, 149; 317/157.5; 335/284
See application file for complete search history.

(56) References Cited

U.S. PATENT DOCUMENTS 1,988,040 A * 1/1935 Herbert ..... 148/509
3,582,721 A * 6/1971 van Hoorn et al. ..... 361/149
4,058,763 A * 11/1977 Steingroever ..... 324/205
4,360,854 A * 11/1982 Schergen et al. ..... 361/149
4,384,313 A * 5/1983 Steingroever et al. ..... 361/149
4,470,094 A * 9/1984 Armond et al. ..... 361/149
4,672,345 A * 6/1987 Littwin et al. ..... 335/284
5,341,263 A * 8/1994 McGreevy et al. ..... 360/128

FOREIGN PATENT DOCUMENTS

DE 37 18 936 * 12/1988
DE 37 18 936 A1 12/1988

* cited by examiner

*Primary Examiner*—Stephen W. Jackson
*Assistant Examiner*—Terrence Willoughby
(74) *Attorney, Agent, or Firm*—McCormick, Paulding & Huber LLP

(57) ABSTRACT

The method according to the invention for demagnetization is effected in two separate steps. Firstly magnetically hard locations, such as weld seams, pressure locations etc., of an object to be demagnetized is pre-treated locally with high fields by way of choke coils in an alternating field. These magnetically hard locations are at least partly demagnetized by way of this. Subsequently the complete demagnetization is effected in a decisive second step. The object remains for a certain time in an alternating field. Now the alternating field is stepped down in that the current in a series oscillation circuit is stepped down in a current-controlled manner with two coils.

10 Claims, 2 Drawing Sheets

METHOD AND A DEVICE FOR DEMAGNETISING OBJECTS

FIELD OF THE INVENTION

The invention relates to a method and to a device for demagnetizing objects, according to the introductory part of the independent claims.

BACKGROUND OF THE INVENTION

A known method for demagnetizing objects uses an open magnet circuit with a coil which is flown through with a constant alternating current. The magnet core is applied onto the object and the alternating current is switched on. Thereupon the magnet core is slowly pulled away from the object by hand. The demagnetization procedure is greatly influenced by surrounding conditions and may not be precisely reproduced. The demagnetization is incomplete and not always equally good.

Such a method is described in U.S. Pat. No. 4,384,313 (Steingrover). With this, the frequency of the supply voltage of the coil is moved slowly up to the resonance frequency of the associated oscillation circuit, whereupon the voltage is reduced and thus the amplitude of the alternating field acting on the parts to be demagnetized is reduced. A disadvantage of this method lies in the fact that a lot of time is required for the approach to the resonance frequency. The time required is so large that an efficient demagnetization of objects is not possible with a pass-through method.

With a further known method according to DE 3718936 A1 one operates with a coil tunnel with large electromagnets which are flown through by alternating current. The object is pulled through the coil tunnel with a stationary magnetic field. By way of this the object is firstly increasingly subjected to the magnetic field and then reducingly. The demagnetizing effect is limited. Here the effect is improved by mechanically rotating the electromagnets.

With today's use of materials for mechanical components and the widespread use of sensitive electronic components and circuits, the residual magnetism in objects becomes more of a major problem. The residual magnetism present in the objects becomes a major quality criterion for suppliers. By way of greater technology and material selection one may reduce the cost factor in particular with the manufacture of parts in masses. However one has to reckon with other disturbing factors such as indeed the residual magnetism.

SUMMARY OF THE INVENTION

It is the object of the invention to specify a method with which objects may be demagnetized to the extent that no measurable residual magnetism is present any longer.

A further object of the invention is to specify a device with which objects may be demagnetized according to the method.

This object is achieved by the invention according to the independent patent claims.

BRIEF DESCRIPTION OF THE DRAWINGS

The invention is hereinafter described in combination with the drawings. There are shown in.

DETAILED DESCRIPTION OF THE PREFERRED EMBODIMENTS

Hereinafter the basics and the basic concepts of the method according to the invention will be dealt with. The method is suitable for all types of ferromagnetic parts, such as for example punched parts, turned parts, springs, tubes etc.

In a step which according to the invention is decisive, the whole system, in this case the ferromagnetic objects as a whole are completely demagnetized. Instead of the ferromagnetic objects being pulled through a magnetic alternating field according to the state of the art, for a certain time they remain locally in the magnetic field within one station. Now the change of the alternating field in this station is controlled in that the coils are electronically controlled with regard to frequency and amplitude. During a certain staying time of the ferromagnetic objects in the station the alternating field is brought to zero, whereupon the ferromagnetic objects are removed from the station. It is now demagnetized to the extent that residual magnetism may no longer be measured. The sequence of the demagnetization thus takes place in cycles.

A particular case is represented by the frames and extensions of shadow masks of screens, for which the method follows a pre-treatment. With the method with the pre-treatment, firstly magnetically hard locations in the subject to be treated, such as weld seams, air gaps etc. are pre-treated locally with high fields by way of a rod choke coil, with a coil with a rod-like laminated iron core. These magnetically hard locations are at least partly demagnetized by way of this.

Figure 1:
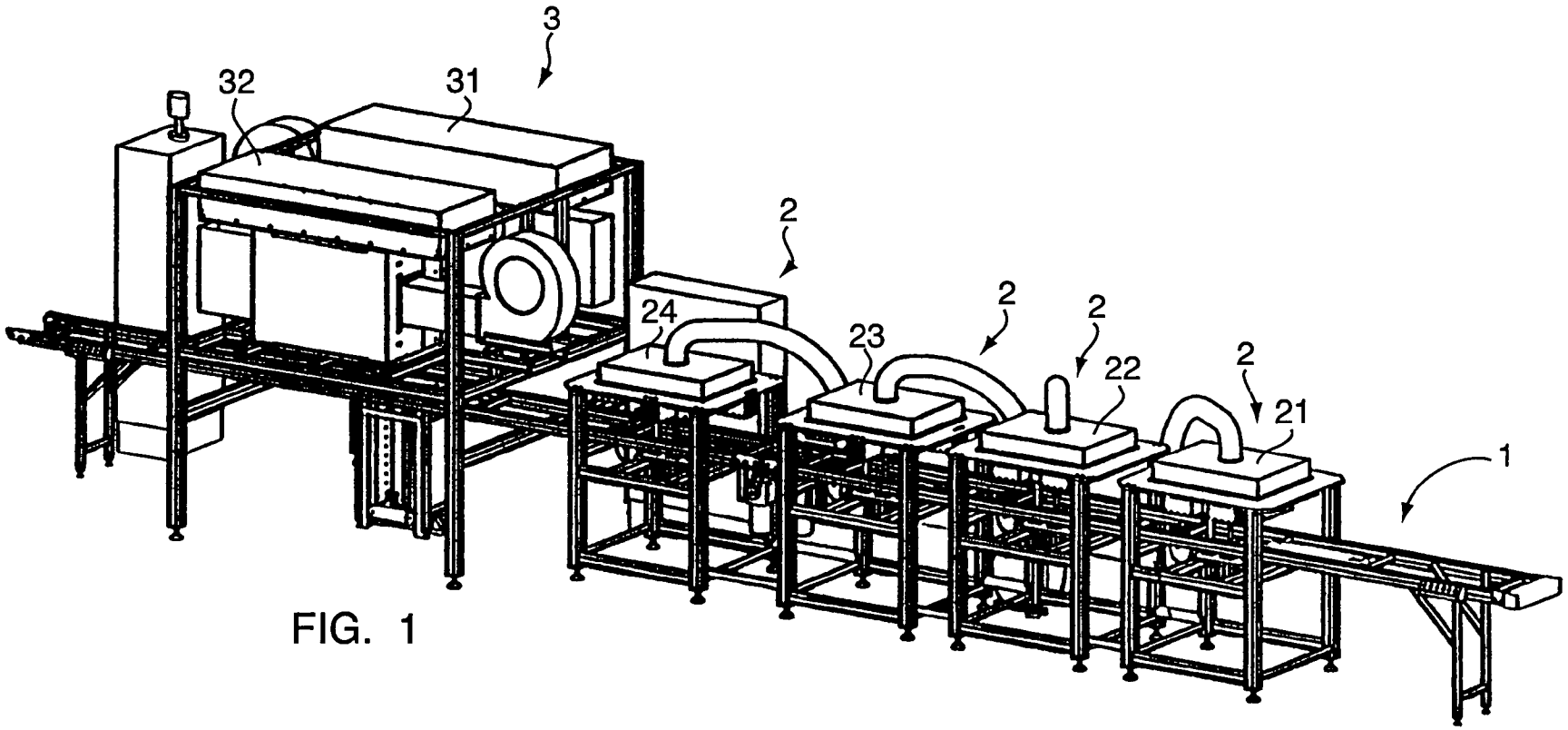
FIG. 1 shows a device in an elevational view.

The device according to FIG. 1 shows an embodiment which functions according to these basic concepts. The demagnetization device comprises a transport path 1 on which the objects to be demagnetized are transported to and away and further. The transport path leads through the demagnetization station 3. In the special case with which a pre-treatment is also carried out, the transport path 1 leads under below and past one or more pre-treatment stations 2 and subsequently to the demagnetization station 3

Each pre-treatment station 2 comprises a rod choke coil 21-24 of a known type. The demagnetization station 3 comprises two boxes 31, 32 lying opposite one another which each comprise a coil. The two boxes with the coils distanced to one another form a zone in which a homogeneous field is produced. The two coils are part of a series oscillation circuit which is controlled by current by way of an inverter. The two coils in the boxes 31, 32 are arranged opposite one another on both sides of a transport belt.

The objects are now transported in a cycle on the transport path from pre-treatment station 2 to pre-treatment station 2 and finally transported through the demagnetization station 3. The object remains in each station for a certain time duration. In the pre-treatment stations the magnetically hard locations are pre-treated with strong fields so that they may no longer be ascertained as such and the magnetic properties are more or less compensated.

The cycle times are adapted to the problem or to the treatment times in the individual stations. At the same time the longest treatment time in one of the stations dictates the cycle rate. An automatisation is possible.

In the actual and significant demagnetization station 3 the magnetic properties of the objects are reduced to a value which may no longer be measured. In this station too the objects remain stationary during the time necessary for influencing.

It is therefore the case of a cycled passage method. The transport of the objects by the transport belt is thus effected in a cycled manner in a start-stop or quick-slow operation. One uses a control of the known type for this cycled passage method with the transport and with operation of the pre-treatment stations 2.

For activating the demagnetization station 3 alternatively one employs two variants of activation:

Firstly the penetration depth of the magnetic intensity into the object given the same amplitude of the alternating field is dependent on the frequency of the alternating field. The staying time is also set by way of this. For material of 1 mm thickness a frequency of the alternating field of about 200 Hz for example is sufficient, which corresponds to a pulse time of at least 0.5 seconds. The frequency reduces with an increasingly required penetration depth or material thickness. For an object with 10 mm material thickness, the required frequency of the alternating field corresponds to about 10 Hz.

Secondly the staying time of the object in the alternating field must correspond to at least one time duration in the magnitude of 100 periods or alternating pulses. The object must remain within the alternating field for this staying time. One thus requires an influencing time of at least 10 seconds. The transport is preferably stopped during this influencing time so that the object remains stationary in the alternating field.

In order to obtain a fast cycle rate for the passage of the demagnetization, the frequency of the alternating filed is now optimized. The demagnetization frequency is a compromise between the production speed, with the highest possible frequency, and the penetration depth which demands a lower frequency. The resonance frequency of the complete oscillation circuit is determined from these settings. Each demagnetization frequency begins on this resonance frequency. At this starting point the object influences the resonance frequency to a negligible extent, since the system is operated in the region of magnetic saturation.

This is then achieved by using a series oscillation circuit with a coil and capacitor. This is accommodated in a dosed box. By way of this the voltage outside the box may be kept low whilst the high voltages required for the alternating field in the series oscillation circuit are only present within the box. This largely prevents any danger to the operating personnel. The station thus comprises two such boxes, in each case on one side of the object. In an alternative variant the two coils of the series oscillation circuit are grouped together into a single long air-core coil. The region with the alternating field is then located longitudinally in the inside within the long air coil.

The series oscillation circuit is then controlled by a current source. This is effected with a current controller or with an inverter. The effect of the magnetic field is kept constant independently of the temperature in the coil. Thus the produced field remains precise without undesired influence by the temperature. The current controller is provided with a zero point correction. The zero point correction balances the current flowing through the series oscillation circuit so that no constant voltage component arises. Thus at this point in time at which the object is removed from the station there no longer prevails any voltage nor charges. The two coils lying opposite one another are preferably equally polarized with respect to the magnetic field.

In a simple variant of the control the internal programming or ramp function of the inverter present in each inverter is used for the control. One starts the inverter and thus the series oscillation circuit at the resonance frequency. One then lets the inverter-series oscillation circuit-system step down. The reduction of frequency and voltage which is usual on account of the internal programming in the inverter is effected in a ratio of about 1:20. By way of this the current reduction in the series oscillation circuit is effected in a region of 1:1000 to 1:5000. The demagnetization curve thus corresponds roughly to the exponential curve E of FIG. 2. The alternating field, according to the above-described principles is reduced or cut back for a time duration of a sequence of between 20 and 500 periods or alternating pulses from the resonance frequency at the point in time T0 to zero at the point in time T (FIG. 3). With trials, one always achieved very good results in demagnetization with a time duration between 50 and 250 periods.

With a second variant the alternating field is likewise reduced or cut back for a time duration of the sequence between 20 and 500 periods or alternating pulses from the resonance frequency at the point in time T0 to zero at the point in time T (FIG. 3). At the same time the time duration of approximately 100 periods is to be seen as an optimal duration period. The oscillation in the series oscillation circuit at the same time is controlled in current control via a current controller.

Figure 2:
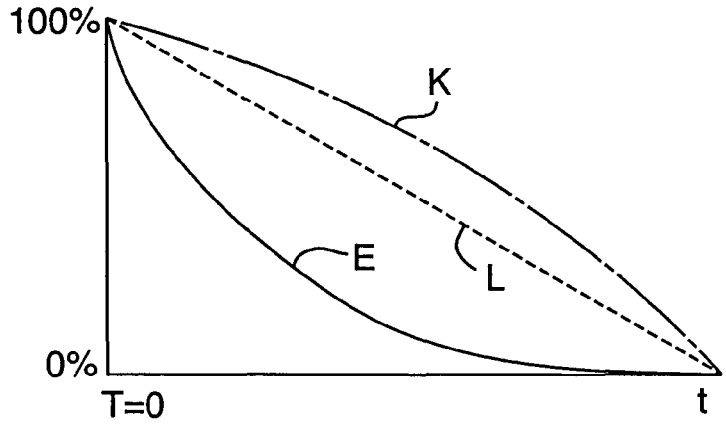
FIG. 2 schematically illustrates demagnetization curves.
Figure 3:
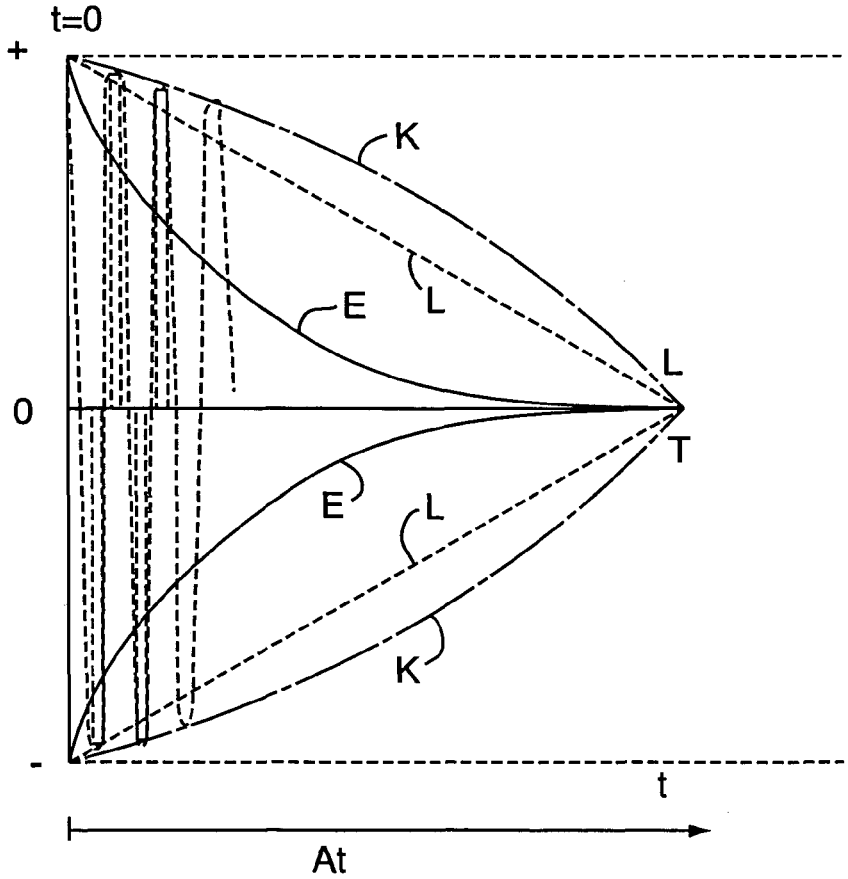
FIG. 3 shows the propping-up of the oscillations.

In FIG. 2 there are shown examples of demagnetization curves, as they are now possible according to this cycled method. The series oscillation circuit provides a usual exponential curve E by way of decaying oscillation. One may now determine the time duration in which the residual magnetism in the object may be brought down to a non-measurable reading. The object remains stationary in the region between the two coils of the series oscillation circuit for this duration period. The oscillations of the series oscillation circuits in a controlled manner are brought to a nominal value (=100%) caused by the necessary penetration depth and subsequently are returned approximately to zero ($10^{-3}$ to $10^{-4}$). It is thus also possible to obtain the end value at a certain amount differing from zero.

According to a second variant one uses a separate current control. The start of the procedure begins at resonance frequency with a maximum current. One then lets the series oscillation circuit decay in a damped manner for the required attenuation time At. The control of the series oscillation circuit here uses an inverter-external current control of the inverter with rectangular impulses. The demagnetization curve is then influenced in that at the beginning of the increase of individual oscillations or each of the oscillations, the series oscillation circuit is additionally supplied by way of rectangular impulses. The separate current control of the inverter is suitable for this. Thus the damping of the oscillations and thus the sequence of the demagnetization may be selected according to the problem. The duration of the procedure is set by the above-mentioned principles. In order to ascertain the end of the procedure one only needs to count the impulses or oscillations. For setting an end value differing from zero one may interrupt the procedure after a certain preselected number of oscillations. This demagnetization curve may then be changed in a linear L or an arcuate curve K for objects which set particular demands on the demagnetization. For this the alternating field of the series oscillation circuit is stepped down along a programmable ramp function from a nominal current to an end current by way of the separate current control.

A monitoring of the procedure and the obtained end values may be effected by separate field measurement by way of separated coils or Hall sensors. This applies to both variants of the activation.

The object is removed from the station after the controlled attenuation of the series oscillation circuits. There is no longer present any voltage and no charge and no magnetic field. This is extraordinarily advantageous for the device for demagnetization. The transport of the objects through the transport belt is effected in a cycled manner in start-stop or quick-slow operation. The work piece is located within the alternating field during the stop or slow phase. After the attenuation of the series oscillation circuit there no longer prevails any voltage. No current flows and there are no longer present any charges. There thus exists no danger of electric shocks to the operating personnel. If thus the device has finally been switched off then no type of residual charges are present. This renders the repair or maintenance for example at the transport belt completely safe.

For improving the cycle rate one may group together and supply several coils or several demagnetization locations under the same conditions into a single series oscillation circuit.

The invention claimed is:

1. A method for demagnetizing objects between two coils lying on opposite longitudinal sides of a transport path relative to one another, wherein the object is located within a region between the two coils within an alternating field for a staying time of a certain duration, and wherein the coils form a single series oscillation circuit which are supplied in a current controlled manner, and wherein the object is previously treated at at least one pre-treatment station for demagnetizing magnetically hard locations in the object.

2. A method according to claim 1, wherein the staying time over the duration of the cycle lasts between 20 and 500 periods.

3. A method according to claim 1, wherein two coils are connected in series to in effect form one single common coil, and wherein the alternating field is produced within the coil.

4. A method according to claim 2, wherein the alternating field of the series oscillation circuit is reduced down from a nominal current to an end current by way of a control or a ramp function which are programmed in the inverter.

5. A method according to claim 4, wherein a demagnetization curve is influenced by additional supply of the series oscillation circuit by way of feeding with rectangular impulses by the separate current control.

6. A method according to claim 4, wherein after completion of the demagnetization procedure, the series oscillation circuit is made to exhibit zero voltage difference across the circuit, zero current and zero charge.

7. A device for demagnetizing objects with a demagnetization station which comprises two coils which are present and which are arranged on opposites longitudinal sides of a transport belt relative to one another, wherein the two coils are coreless and are connected in a single common series oscillation circuit and supplied by way of a current control for producing an alternating field, wherein the series oscillation circuit and the transport belt are operated in a cycled manner so that an object transported on the transport belt remains within an alternating field between the coils of the series oscillation circuit for a certain staying time, and wherein in a transport direction of the transport belt there is present at least one pre-treatment station for demagnetizing magnetically hard locations in the object.

8. A device according to claim 7, wherein the two coils are connected in series to in effect form a single common coil, and wherein the alternating field is produced in the inside of the common coil.

9. A device according to claim 7, wherein the transport of the objects on the transport belt is affected in one of a start-stop and quick-slow cycled manner.

10. A device according to claim 9, wherein the transport of the objects on the transport belt affected in a cycled manner is performed in a start and restart way.

* * * * *